US011318773B2

(12) United States Patent
Ishizuka et al.

(10) Patent No.: US 11,318,773 B2
(45) Date of Patent: May 3, 2022

(54) PRINTING APPARATUS AND METHOD FOR MANUFACTURING PRINTED MATTER

(71) Applicant: SAKATA INX CORPORATION, Osaka (JP)

(72) Inventors: Takashi Ishizuka, Osaka (JP); Yasutsugu Mochizuki, Osaka (JP)

(73) Assignee: SAKATA INX CORPORATION, Osaka (JP)

( * ) Notice: Subject to any disclaimer, the term of this patent is extended or adjusted under 35 U.S.C. 154(b) by 0 days.

(21) Appl. No.: 17/049,306

(22) PCT Filed: Mar. 22, 2019

(86) PCT No.: PCT/JP2019/012064
§ 371 (c)(1),
(2) Date: Oct. 20, 2020

(87) PCT Pub. No.: WO2019/208045
PCT Pub. Date: Oct. 31, 2019

(65) Prior Publication Data

US 2021/0245541 A1 Aug. 12, 2021

(30) Foreign Application Priority Data

Apr. 27, 2018 (JP) ..... JP2018-087841
Apr. 27, 2018 (JP) ..... JP2018-087842
Jul. 19, 2018 (JP) ..... JP2018-135672

(51) Int. Cl.
*B41M 7/00* (2006.01)
*B41J 11/00* (2006.01)

(52) U.S. Cl.
CPC ..... *B41M 7/0045* (2013.01); *B41J 11/00218* (2021.01); *B41M 7/009* (2013.01)

(58) Field of Classification Search
CPC ... B41M 2205/12; B41M 5/0047; B41M 7/00
See application file for complete search history.

(56) References Cited

U.S. PATENT DOCUMENTS 5,477,784 A * 12/1995 Floegel ..... B41M 1/30 101/489
7,887,635 B2 * 2/2011 Kim ..... C23C 16/00 118/723 VE (Continued)

FOREIGN PATENT DOCUMENTS

CN 204936502 U 1/2016
JP 2003218099 A 7/2003

(Continued)

OTHER PUBLICATIONS

International Search Report (ISR) dated May 14, 2019, issued for International application No. PCT/JP2019/012064 (2 pages).

(Continued)

*Primary Examiner* — John Zimmermann
(74) *Attorney, Agent, or Firm* — Law Office of Katsuhiro Arai

(57) ABSTRACT

A printing apparatus is provided that has: a printing part that performs printing by depositing a recording composition on the surface of a printing medium; a plasma generation part that is constituted by a plasma generation chamber having an introduction port for introducing a gaseous flow of plasma material gas to the interior, wherein the plasma material gas is converted to a plasma in the interior to form a gaseous flow of plasma-modified gas, as well as a plasma release port for releasing the gaseous flow to the exterior; and a plasma irradiation part that brings a gaseous flow released from the plasma release port, which contains the plasma-modified gas and/or plasma-quenched gas formed therefrom, in contact with the surface of the printing medium that has been printed at the printing part. The printing apparatus can fully dry/cure a printed recording composition.

14 Claims, 7 Drawing Sheets

(56) References Cited

U.S. PATENT DOCUMENTS

| | | | | |
|---|---|---|---|---|
| 2006/0082604 | A1* | 4/2006 | Florence | B41J 11/0021 347/5 |
| 2009/0175663 | A1* | 7/2009 | Taniuchi | G03G 15/161 399/320 |
| 2011/0199446 | A1* | 8/2011 | Ram | B41J 11/0015 347/101 |
| 2012/0156444 | A1* | 6/2012 | Takemoto | B32B 7/12 428/195.1 |
| 2013/0250017 | A1 | 9/2013 | Saitoh et al. | |
| 2015/0030823 | A1 | 1/2015 | Stamatoukos et al. | |
| 2015/0202894 | A1 | 7/2015 | Kitada et al. | |
| 2016/0271874 | A1 | 9/2016 | Tsai et al. | |
| 2017/0145263 | A1* | 5/2017 | Festa, Sr. | B41M 5/0047 |

FOREIGN PATENT DOCUMENTS

| | | | |
|---|---|---|---|
| JP | 2004279491 | A | 10/2004 |
| JP | 2005026171 | A | 1/2005 |
| JP | 2005154748 | A | 6/2005 |
| JP | 2007054987 | A | 3/2007 |
| JP | 2007106105 | A | 4/2007 |
| JP | 2008012919 | A | 1/2008 |
| JP | 4649952 | B2 | 3/2011 |
| JP | 2012102217 | A | 5/2012 |
| JP | 2012237032 | A | 12/2012 |
| JP | 2013010933 | A | 1/2013 |
| JP | 2013129123 | A | 7/2013 |
| JP | 2013203067 | A | 10/2013 |
| JP | 2014053136 | A | 3/2014 |
| JP | 2015199298 | A | 11/2015 |
| JP | 2016060157 | A | 4/2016 |

OTHER PUBLICATIONS

Notification Concerning Transmittal of International Preliminary Report on Patentability (PCT/IB/326) and Notification of Transmillal of Translation of the International Preliminary Report on Patentability (PCT/IB/338) dated Nov. 5, 2020, with International Preliminary Report on Patentability (PCT/IB/373) and Written Opinion of he International Searching Authority (PCT/ISA/237), for corresponding international application PCT/JP2019/012064 (20 pages).

Extended European Search Report (EESR) dated Nov. 25, 2021, issued for European counterpart patent application No. EP19793528.1 (9 pages).

* cited by examiner

[FIG. 1]
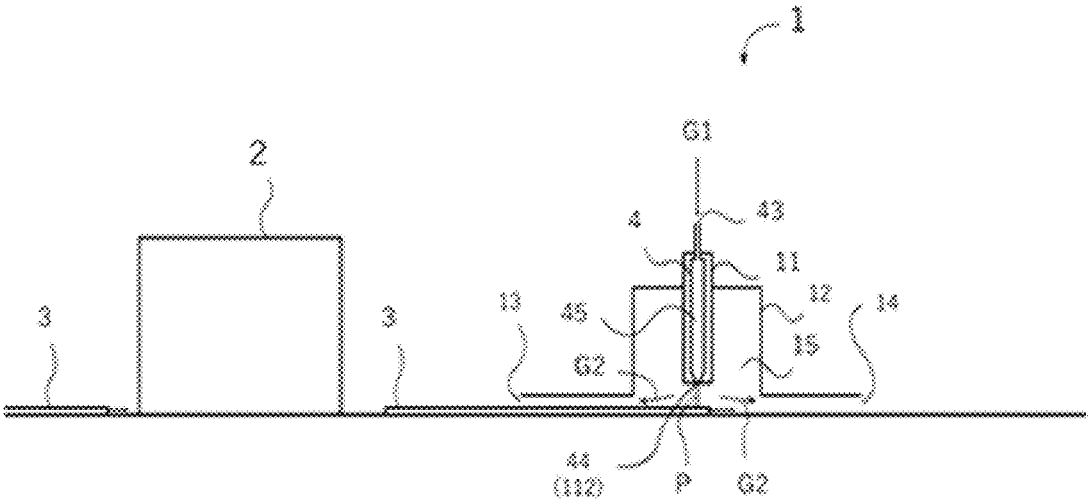
[FIG. 2]
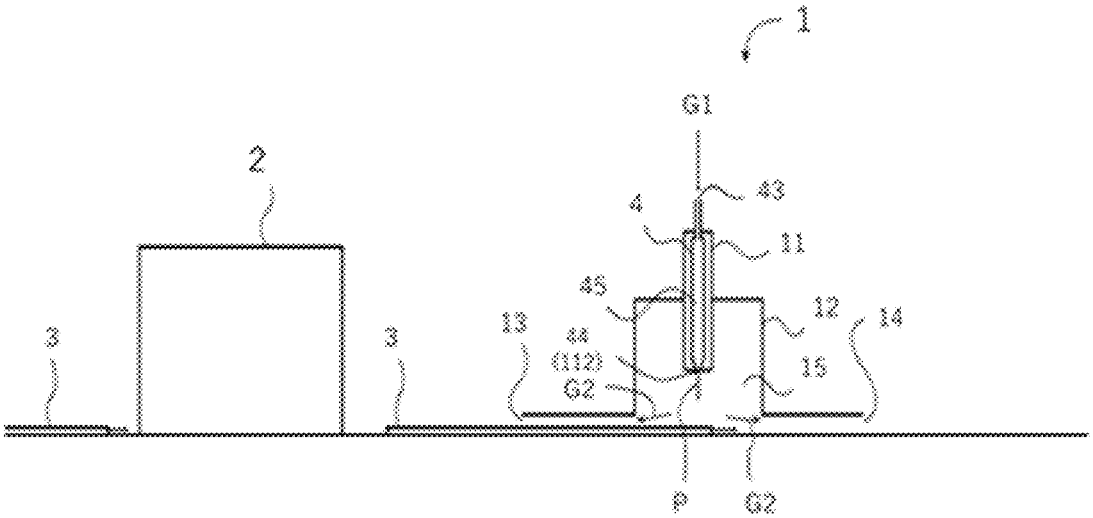

[FIG. 3]
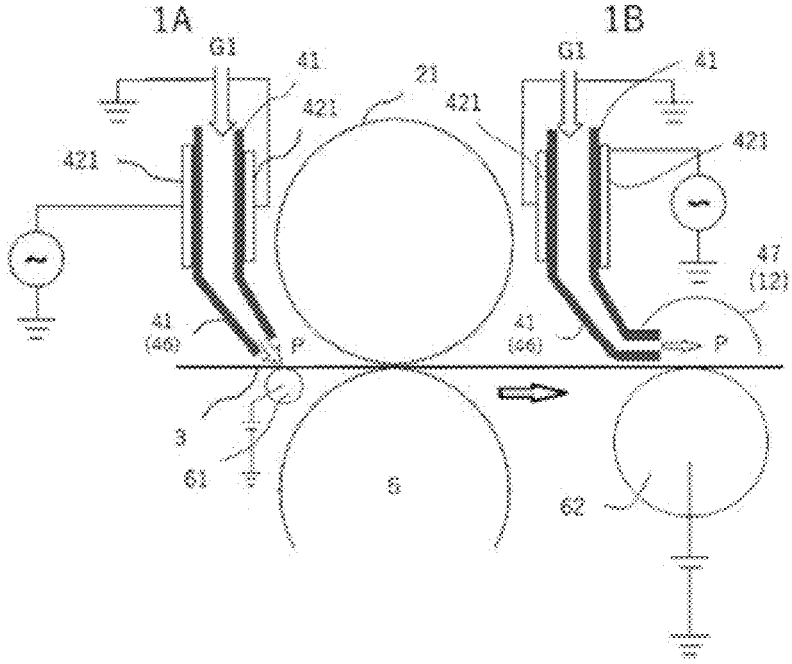

[FIG. 4]
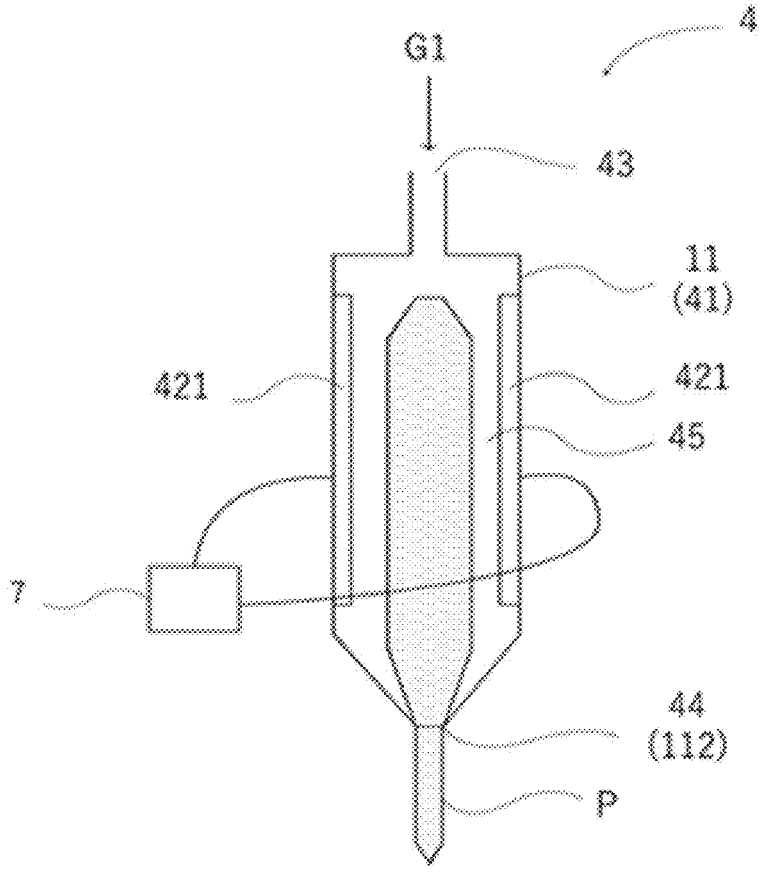

[FIG. 5]
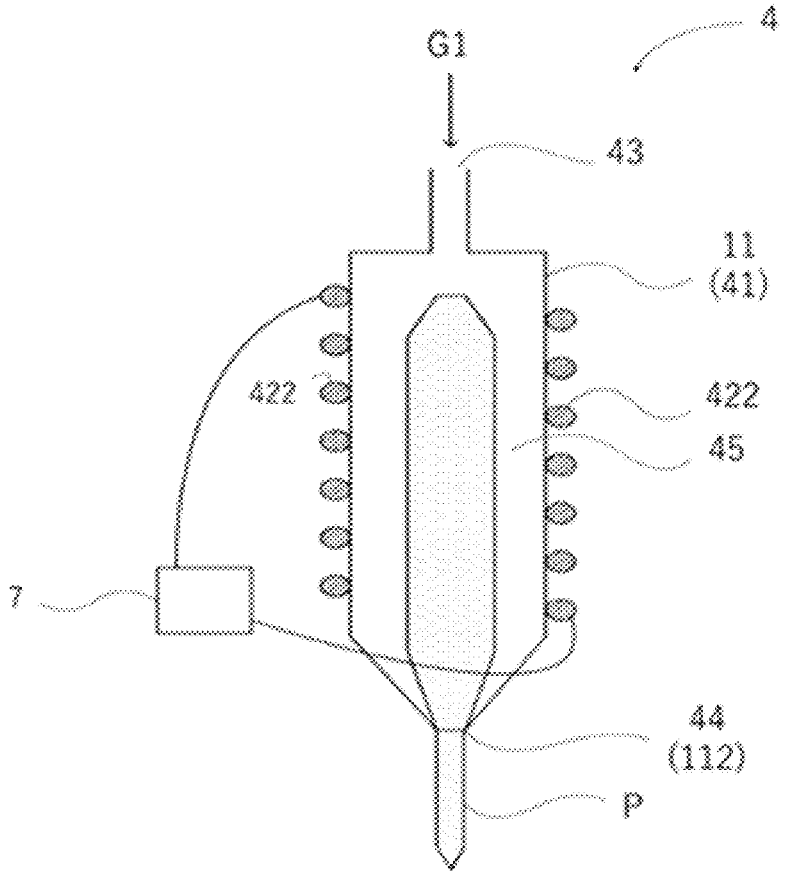

[FIG. 6]
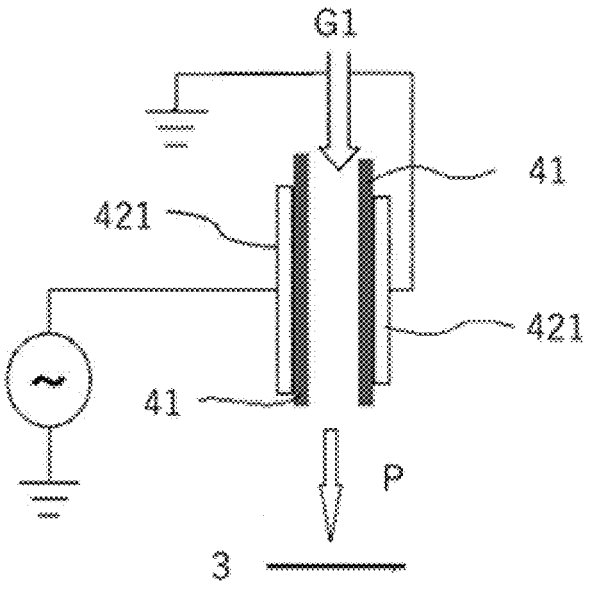
[FIG. 7]
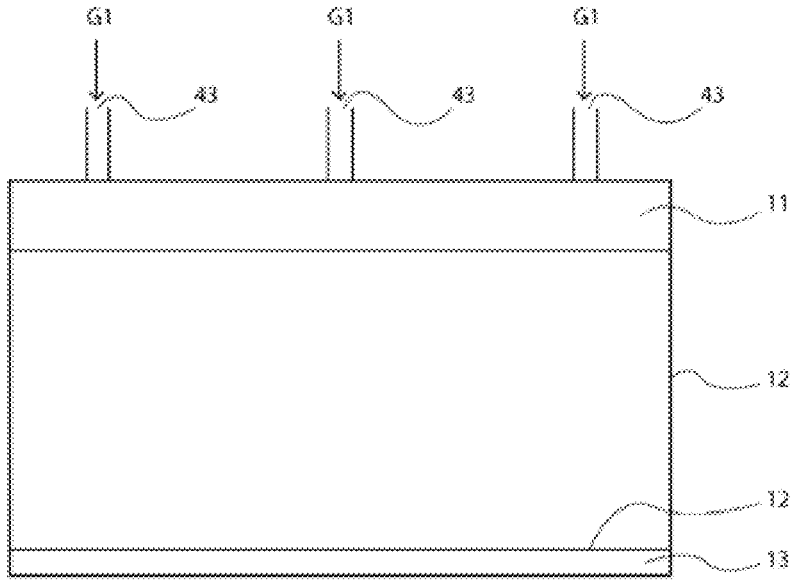

[FIG. 8]
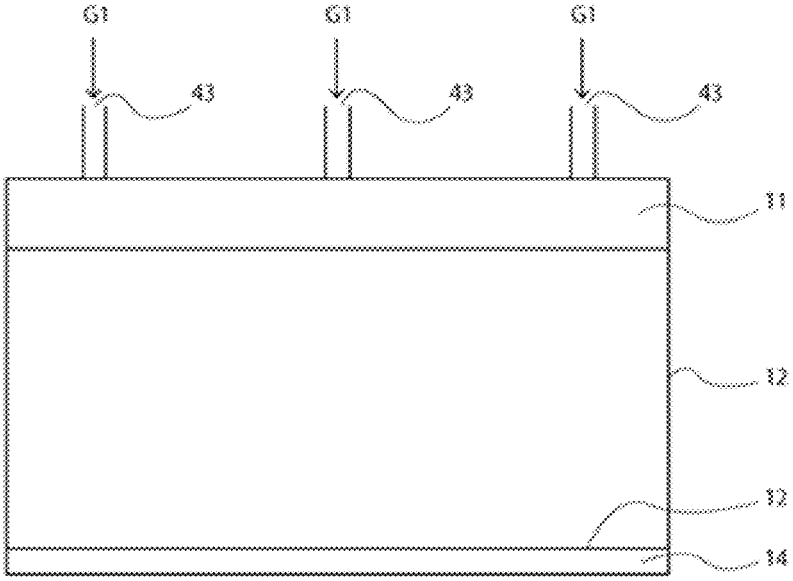
[FIG. 9]
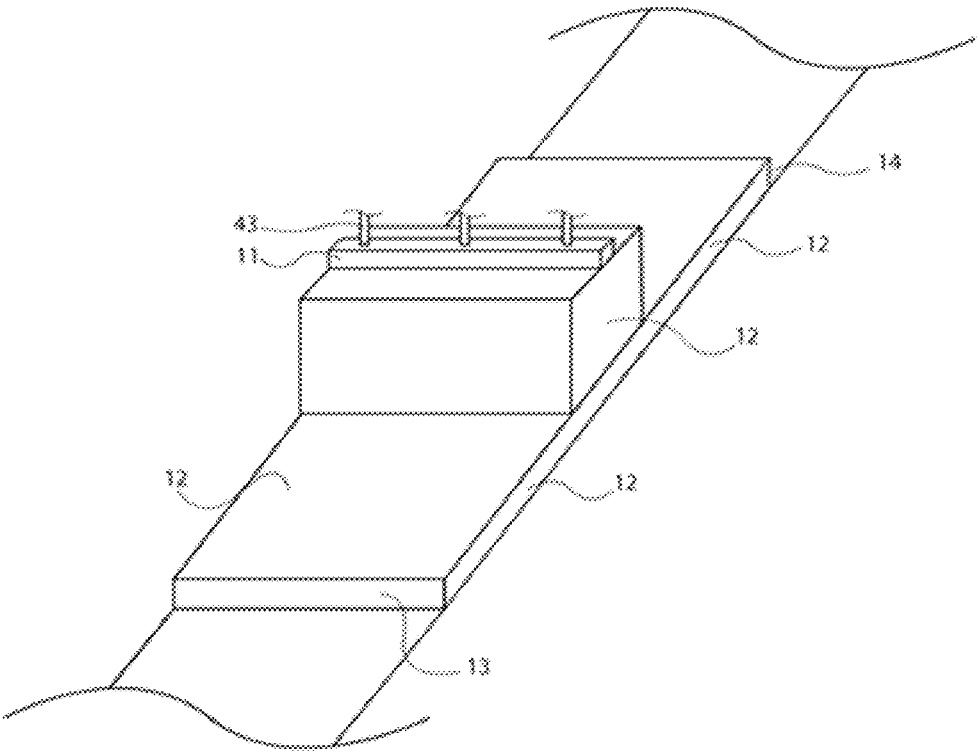

[FIG. 10]
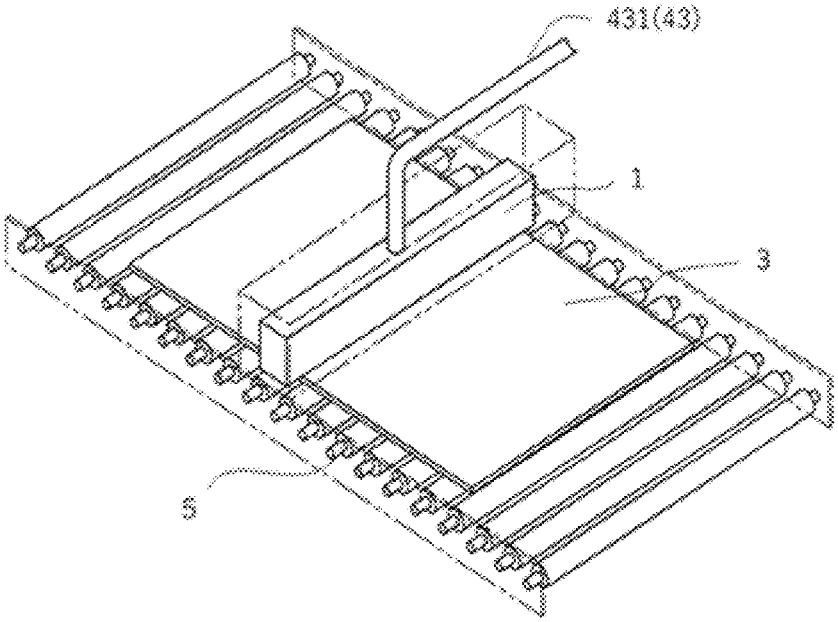

PRINTING APPARATUS AND METHOD FOR MANUFACTURING PRINTED MATTER

CROSS-REFERENCE TO RELATED APPLICATIONS

This application is the U.S. National Phase under 35 U.S.C. § 371 of International Application PCT/JP2019/012064, filed Mar. 22, 2019, which claims priority to Japanese Patent Application Nos. JP2018-087841, filed Apr. 27, 2018, JP2018-087842, filed Apr. 27, 2018, and JP 2018-135672, Jul. 19, 2018. The International Application was published under PCT Article 21(2) in a language other than English.

TECHNICAL FIELD

The present invention relates to a printing apparatus and a method for manufacturing printed matter.

BACKGROUND ART

Printed matter refers to paper and other printing media on the surface of which letters and images have been formed by depositing ink and other recording compositions and then fixing them by means of permeation, curing, evaporation, thermal fusion, etc. Printed matter on which recording compositions have been fixed can be post-processed or stacked together. If the recording compositions are not fixed sufficiently, however, the ink compositions on one printed matter may transfer onto the back of the printed matter placed on top, the printed surface may be scratched during the post-processing, or the device may be stained during the post-processing. For these reasons, recording compositions are required to have high fixability (quick drying property).

Patent Literatures 1 and 2 describe using ultraviolet (UV)-curable recording compositions as recording compositions having high fixability (quick drying property). A UV-curable recording composition contains a photopolymerization initiator that produces radical, cationic, or other active species when irradiated by ultraviolet light, along with monomers that polymerize and cure in the presence of such active species. Unlike the conventional recording compositions, however, UV-curable recording compositions can present such problems as lower printability and higher cost due to use of photopolymerization initiators and monomers.

Patent Literatures 3 to 8 propose methods for fixing recording compositions that involve use of types of materials close to the conventional recording compositions and irradiation of a plasma after printing. A plasma is formed when a gas present in a discharge space is ionized.

Plasma irradiation methods are classified into the direct type and the remote type. Direct plasma irradiation is a method whereby an irradiation target is directly fed into a discharge space to be irradiated with a plasma. Remote plasma irradiation is a method whereby a plasma material gas is passed from the exterior to the interior of a discharge space, after which the gas that has been converted to a plasma is let flow out of the discharge space to contact an irradiation target.

Direct plasma irradiation may damage the irradiation target (paper or other printing medium) as it passes through the discharge space. Remote plasma irradiation does not cause such problem, but plasma reactivity may drop due to movement of the gas in plasma state or the gas in plasma state may diffuse, etc., leading to insufficient fixing of the recording composition.

Patent Literature 3 describes an inkjet printing apparatus whose ink ejection nozzle and plasma ejection port are provided on the same carriage to surface-treat a printing target with a plasma before an ink is ejected from the nozzle. This device does not perform any processing on the printed ink. Also, the carriage, having the ink ejection nozzle and plasma ejection port, becomes larger in size, and heavy. As a result, the device requires a very high motor output to move the carriage, as well as a constitution to control the inertial force generated by the back-and-forth motion of the carriage.

Patent Literature 4 describes an ink fixing device that performs a discharge between electrodes near a base material that has been inkjet-printed. The device employs a direct plasma irradiation method and can irradiate a highly reactive plasma immediately after its generation, and may be able to cure at least a part of the ink on the base material. However, the process of generating a plasma between the electrodes that are positioned on both sides of the base material that lies in between, and thus generating a discharge directly over the base material, may damage the printing medium. Also, the discharge may generate at a position between the electrodes where such discharge can occur easily. This makes it difficult to treat the base material evenly over its entire width when the width of the base material increases.

Patent Literature 5 describes a transfer printing apparatus adopting the inkjet method, wherein a transferred recording agent is plasma-treated at normal pressure to fix the recording agent; Patent Literature 6 describes a device for performing atmospheric-pressure plasma treatment and UV exposure treatment on a curable composition that has been inkjet-printed on a base material; and Patent Literature 7 describes a device for performing atmospheric-pressure plasma treatment on a curable composition that has been inkjet-printed on a base material.

Patent Literature 8 describes curing an oxidative polymerizable ink that has been printed on a medium, by causing it to come in contact with anions generated by converting a gas to a plasma. The idea is to place media bearing the printed ink in batches in a space where a plasma is present, to cure the ink.

With the inventions described in Patent Literatures 5 to 8, the orientation in which an atmospheric-pressure plasma is irradiated is unclear. Additionally, since the atmospheric-pressure plasma itself is accompanied by a gaseous flow, directly irradiating it may diminish the intended sharpness as the paths of inkjet ink droplets as well as printed dots, outlines, etc., are disturbed by the gaseous flow.

BACKGROUND ART LITERATURE

Patent Literature

Patent Literature 1: Japanese Patent Laid-open No. 2012-102217

Patent Literature 2: Japanese Patent No. 4649952

Patent Literature 3: Japanese Patent Laid-open No. 2015-199298

Patent Literature 4: Japanese Patent Laid-open No. 2007-106105

Patent Literature 5: Japanese Patent Laid-open No. 2008-12919

Patent Literature 6: Japanese Patent Laid-open No. 2013-203067

Patent Literature 7: Japanese Patent Laid-open No. 2013-10933

Patent Literature 8: Japanese Patent Laid-open No. 2007-54987

SUMMARY OF THE INVENTION

Problems to Be Solved by the Invention

Methods of irradiating a plasma onto printed matter represent a new class of methods for drying/fixing recording compositions, and are superior to the drying/fixing methods involving ultraviolet irradiation in that the liberation of decomposition products of unreacted monomers and photopolymerization initiator, etc., from the printed matter can be prevented. Drying of a recording composition under a plasma irradiation method is achieved by using a plasma to cause the components in the recording composition to undergo chemical reaction and thereby cure.

However, use of a plasma of extremely high energy should be avoided in consideration of the potential damage the printing medium could receive when irradiated with the plasma. When a plasma of low energy is used, on the other hand, insufficient reaction activity may result in poor fixing.

An object of the present invention is to provide a printing apparatus and a method for manufacturing printed matter, each capable of fully drying/curing a printed recording composition using a plasma generated by a remote plasma generation device.

Also, another object of the present invention is to provide a device and a method for manufacturing printed matter, each designed to dry/cure a printed recording composition with a gaseous flow containing plasma-modified gas and/or plasma-quenched gas, while preventing the shape of the recording composition on the printing medium from being disturbed by the gaseous flow.

Means for Solving the Problems

After studying in earnest to achieve the aforementioned objects, the inventors of the present invention completed the invention described below:

[1] A printing apparatus, having:

a printing part that performs printing by depositing a recording composition on the surface of a printing medium;

a plasma generation part that is constituted by a plasma generation chamber having: an introduction port for introducing a gaseous flow of plasma material gas to the interior, wherein the plasma material gas is converted to a plasma in the interior to form a gaseous flow of plasma-modified gas; and a plasma release port for releasing the gaseous flow to the exterior; and a plasma irradiation part that brings a gaseous flow released from the plasma release port, which contains the plasma-modified gas and/or plasma-quenched gas formed therefrom, in contact with the surface of the printing medium that has been printed at the printing part.

[2] The printing apparatus according to [1], wherein the gaseous flow containing plasma-modified gas is brought in contact with the surface of the printing medium that has been printed at the printing part.

[3] The printing apparatus according to [1], wherein the gaseous flow containing plasma-quenched gas is brought in contact with the surface of the printing medium that has been printed at the printing part.

[4] The printing apparatus according to [1], wherein the printing part is a printing part that performs printing using a printing roller; the plasma generation part generates an atmospheric-pressure plasma; and the plasma irradiation part has a tip from which the gaseous flow is released and which is oriented in such a direction that the gaseous flow will not be released directly onto the printing medium.

[5] The printing apparatus according to [1], wherein the printing part is a printing part that performs printing using a printing roller; the plasma generation part generates an atmospheric-pressure plasma; and the plasma irradiation part has a tip from which the gaseous flow is released, as well as a cover enclosing the tip and extending in the width direction of the printing medium, and the gaseous flow is released into the cover from the tip.

[6] The printing apparatus according to any one of [1] to [5], wherein the plasma generation part and the plasma irradiation part are placed in such a way that they are connected to each other via the plasma release port, while separated from each other spatially other than at this connected location.

[7] The printing apparatus according to any one of [1] to [6], wherein the plasma irradiation part has a wall face provided with an inlet opening part and an outlet opening part, each of the size needed to let the printing medium go in/out through it.

[8] The printing apparatus according to any one of [1] to [7], wherein the opening part of the plasma release port is oriented in the moving direction of the printing medium so that the gaseous flow of plasma-modified gas and/or plasma-quenched gas will be oriented in the direction in which the printing medium moves.

[9] The printing apparatus according to any one of [1] to [8], wherein the opening part of the plasma release port is not oriented in the surface direction of the printing medium.

[10] The printing apparatus according to any one of [1] to [9], wherein, at the plasma irradiation part, a member connected to the ground or charged with negative electricity or positive electricity is placed on the opposite side of the printing medium as viewed from the plasma release port.

[11] The printing apparatus according to any one of [1] to [10], wherein a plasma irradiation part that releases directly onto the moving printing medium the gaseous flow containing plasma-modified gas and/or plasma-quenched gas formed therefrom, is further provided upstream of the printing part that performs printing on the moving printing medium using a printing roller.

[12] A method for manufacturing printed matter, including: a printing step to perform printing by depositing, on the surface of a printing medium, a recording composition having the property to cure upon contacting a plasma-modified gas and/or plasma-quenched gas formed therefrom; and a drying step to bring a gaseous flow of plasma-modified gas and/or plasma-quenched gas in contact with the surface of the printing medium and thereby fix the recording composition present on the surface of the printing medium;

wherein, in a plasma generation chamber which is connected via a plasma release port to a space through which the printing medium passes and which is separated from the space, a plasma material gas is introduced into the plasma generation chamber from an introduction port different from the plasma release port to form a gaseous flow traveling from the introduction port to the plasma release port, so that the gaseous flow is converted to a plasma in the plasma generation chamber and a plasma-modified gas is generated, after which the plasma-modified gas is released from the plasma release port into the space through which the printing medium passes in order to bring a gaseous flow containing plasma-modified gas and/or plasma-quenched gas formed therefrom in contact with the surface of the printing medium that has been printed in the printing step.

[13] The method for manufacturing printed matter according to [12], wherein the space through which the printing medium passes is covered with a wall face having an inlet opening part and an outlet opening part, each of the size needed to let the printing medium go in/out through it, and the gaseous flow containing plasma-modified gas and/or plasma-quenched gas will flow at least in one of the directions toward the inlet opening part and the outlet opening part.

Effects of the Invention

According to the present invention, a printing apparatus and a method for manufacturing printed matter, each capable of fully drying/curing a printed recording composition using a plasma generated by a remote plasma generation device, can be provided.

Also, according to the present invention, a device and a method for manufacturing printed matter, each designed to dry/cure a printed recording composition with a gaseous flow containing plasma-modified gas and/or plasma-quenched gas, while preventing the shape of the recording composition on the printing medium from being disturbed by the gaseous flow, can be provided.

BRIEF DESCRIPTION OF THE DRAWINGS

FIG. 1 A drawing showing an example of the printing apparatus proposed by the present invention, wherein a gaseous flow containing plasma-modified gas is brought in contact with the surface of a printing medium.

FIG. 2 A drawing showing an example of the printing apparatus proposed by the present invention, wherein a gaseous flow containing plasma-quenched gas is brought in contact with the surface of a printing medium.

FIG. 3 A drawing showing an example of the printing apparatus proposed by the present invention, wherein a gaseous flow containing plasma-modified gas and/or plasma-quenched gas is not ejected directly onto the surface of a printing medium.

FIG. 4 A cross-sectional side view showing an example of the plasma generation part 4.

FIG. 5 A cross-sectional side view showing an example of the plasma generation part 4.

FIG. 6 A cross-sectional side view showing an example of the plasma generation part 4.

FIG. 7 A front view of the plasma irradiation part 1.

FIG. 8 A rear view of the plasma irradiation part 1.

FIG. 9A perspective view showing a schematic illustration of the plasma irradiation part 1.

FIG. 10 A drawing showing a general plasma treatment device.

DESCRIPTION OF THE SYMBOLS

1 Plasma irradiation part
1A Upstream plasma irradiation part
1B Downstream plasma irradiation part
11 Enclosure
112 Plasma release port
12 Wall face
13 Inlet opening part
14 Outlet opening part
15 Space (through which the printing medium 3 passes)
2 Printing part
21 Printing roller
3 Printing medium
4 Plasma generation part
41 Insulator body
421 Electrode
422 Coil
43 Introduction port
431 Introduction tube
44 Tip
45 Plasma generation chamber
46 Nozzle
47 Cover
51 Transfer roll
61 Backup roll
62 Backup roll
7 Power supply
P Plasma-modified gas
G1 Plasma material gas
G2 Gaseous flow containing plasma-modified gas and/or plasma-quenched gas formed therefrom

MODE FOR CARRYING OUT THE INVENTION

An embodiment of the printing apparatus proposed by the present invention, and an embodiment of the method for manufacturing printed matter proposed by the present invention, are explained respectively below.

For the plasma under the present invention, any scientifically defined plasma may be used without limitation. Any plasma may be used so long as it is in a state of a high-energy gas containing charged particles generated by ionization, where the number of ions is the same as or roughly the same as the number of electrons, and also in an electrically neutral or quasi-neutral state. Plasma can be generated by various methods such as a discharge between electrodes separated from each other.

"Plasma-modified gas" under the present invention refers to a gas containing the aforementioned plasma. Immediately after its generation, the plasma contained in the plasma-modified gas is in a high-energy state accompanied by emission of light. For this reason, the plasma emits light of a given color according to the type of plasma material gas, and can induce various chemical reactions.

"Plasma-quenched gas" under the present invention refers to a gas formed from a plasma-modified gas after the plasma in the plasma-modified gas has lost energy, and quenched and become invisible. For example, the plasma contained in the plasma-modified gas gradually loses energy and quenches as it travels over a long distance in the gaseous flow, and eventually becomes invisible. Also, the light-emitting plasma contained in the plasma-modified gas can be quenched by an energy-stripping operation, etc., into an invisible state.

It should be noted that, in this Specification, a gaseous flow containing plasma-modified gas and/or plasma-quenched gas may also be referred to simply as a "gaseous flow G2."

<Printing Apparatus>

The printing apparatus in an embodiment of the present invention has: a printing part 2 that performs printing by depositing a recording composition on the surface of a printing medium 3; a plasma generation part 4 that is constituted by a plasma generation chamber 45 having an introduction port 43 for introducing a gaseous flow of plasma material gas G1 to the interior, wherein the plasma material gas is converted to a plasma in the interior to form a gaseous flow containing plasma-modified gas P, as well as a plasma release port 112 for releasing the gaseous flow to the exterior; and a plasma irradiation part 1 that brings a gaseous flow G2 released from the plasma release port 112, which contains the plasma-modified gas P and/or plasma-quenched gas formed therefrom, in contact with the surface of the printing medium 3 that has been printed at the printing part 2.

The printing medium 3 printed at the printing part 2 is transferred to the plasma irradiation part 1 through an inlet opening part 13 which serves as an inlet to the plasma irradiation part 1, and contacts the gaseous flow G2. Upon contacting the gaseous flow G2, the recording composition present on the surface of the printing medium 3 cures and fixes on the surface of the printing medium 3. After contacting the gaseous flow G2, the printing medium 3 is transferred to the exterior of the device through an outlet opening part 14 which serves as an outlet from the plasma irradiation part 1. Once transferred to the exterior of the device, the printing medium 3 is folded, cut and/or otherwise processed as necessary into a book, poster, or other printed product.

<Printing Medium>

Examples of the printing medium 3 include coated paper, plain paper, and other papers, various resin films, metal films, laminate films having metal layers or metal compound layers, and various other printable media.

(Printing Part)

The printing part 2 is a device that performs printing on the transferred printing medium 3 using a recording composition. The printing part 2 includes a printing press. Or, a printing press may constitute the printing part 2 all by itself. For this printing press, any known printing press may be used. For example, it may be an offset printing press, flexographic printing press, gravure printing press, inkjet printing press, electrophotographic device, etc. Also, each such printing press may be one adopting the sheet-fed method whereby printing media are fed by one sheet at a time, or the rotary method whereby a continuous web of printing medium is taken up.

In an embodiment of the present invention, the printing part 2 may be a printing part that adopts a method whereby a recording composition on a plate or transfer roller is transferred onto the printing medium 3 (lithographic, letterpress, intaglio, or other known printing method).

It should be noted that an atmospheric-pressure plasma irradiation nozzle capable of irradiating a weak plasma on the recording composition still on the plate or transfer roller before being transferred onto the printing medium 3, may be provided at a position opposite the surface of the plate or transfer roller. This way, when the printed recording composition is plasma-treated, its interior can be cured without fail.

(Recording Composition)

For the recording composition, a composition having the property to cure upon contacting the gaseous flow G2 is used. Any recording composition appropriate for the printing press included in the printing part 2 should be selected. For an offset printing press, for example, an offset sheet-fed printing ink, offset rotary printing ink, newspaper printing ink, etc., is used. A flexographic printing ink, etc., may be used for a flexographic printing press, a gravure printing ink, etc., may be used for a gravure printing press, an inkjet printing ink, etc., may be used for an inkjet printing press, or a toner composition for developing electrostatic images (powder (toner composition) that attach to an electrostatic image formed on a photosensitive drum to develop the image), etc., may be used for an electrophotographic device, respectively. For the recording composition, a known composition is used that contains at least one type of component selected from pigment component, biner component, solvent component, etc. The recording component used may be transparent, monochromatic, or polychromatic.

(Plasma Generation Part)

The plasma generation part 4 at least has a plasma generation chamber 45 for generating a plasma, an insulator body 41 that forms the plasma generation chamber 45, an introduction port 43 for introducing a plasma material gas G1 to the plasma generation chamber 45, a means for forming an electric field inside the plasma generation chamber 45 to cause a discharge, and a plasma release port 112 for releasing out of the plasma generation chamber 45 a plasma-modified gas P containing plasma that has been generated in the plasma generation chamber 45.

When power is supplied to the means for forming an electric field inside the plasma generation chamber 45 to cause a discharge, and the discharge starting voltage is exceeded as a result, a plasma is generated in the plasma generation chamber 45. The plasma material gas G1 is blown into the plasma generation chamber 45 from the introduction port 43 to form a gaseous flow that travels from the introduction port 43, passes through the plasma generation chamber 45, and heads out of the plasma generation chamber from the plasma release port 112. The plasma material gas G1 is turned into plasma as it passes through the plasma generation chamber 45, and released as a gaseous flow containing plasma-modified gas P from the plasma release port 112.

An interior space 15 through which the printing medium 3 passes, and the plasma generation chamber 45 (interior of the plasma generation part 4), are placed in such a way that they are connected to each other via the plasma release port 112, while separated from each other spatially other than at this connected location. As a result, a discharge for the purpose of plasma generation occurs only inside the plasma generation chamber 45 (plasma generation part 4), while discharge in the interior space 15 through which the printing medium 3 passes can be prevented. This means that any discharge to the printing medium 3 for the purpose of plasma generation is prevented, and consequently damage to the printing medium 3 can be prevented.

Examples of the plasma generation part 4 include remote types that generate a plasma in a pressure range of 0.1 to 10 atm, or preferably 0.7 to 1.5 atm. The temperature at which a plasma is generated is not limited in any way, but it is preferably a low temperature (100° C. or below, or preferably 50° C. or below) in consideration of the ease of handling, etc.

The plasma generation chamber 45 may be a space formed by an insulator body 41. For the insulator body 41 that forms the plasma generation chamber 45, glass, ceramics, or other dielectric material is used, for example. Additionally, barium titanate, silicon oxide, aluminum nitride, silicon nitride, silicon carbide, or other dielectric material with a dielectric constant of 2000 or lower may also be used.

The shape of the insulator body 41 that forms the plasma generation chamber 45 is not limited in any way, and may be a cylinder, sphere, box, or other arbitrary shape. The insulator body 41 that forms the plasma generation chamber 45 may be processed in a manner tapering toward its tip 44 (plasma release port 112) and thus shaped like a nozzle.

In an embodiment of the present invention, for example, the plasma generation chamber 45 may be formed by an enclosure 11 having an introduction port 43 and a tip 44 (plasma release port 112), as shown in FIGS. 1 and 2. Also, the plasma generation chamber 45 formed by an insulator body 41 may be covered with an enclosure 11 for protection.

In an embodiment of the present invention, for example, a hole provided in the bottom face of an enclosure 11 may be used as a tip 44 (plasma release port 112), as shown in FIGS. 4 and 5.

A plasma material gas G1 is introduced to the plasma generation chamber 45 of the plasma generation part 4 from an introduction port 43 or an introduction tube 431 connected thereto. The plasma material gas G1 is not limited in any way, although examples include at least one type of gas selected from the group that includes air, oxygen gas, carbon dioxide gas, nitrogen gas, argon gas, water vapor, and other gases. Among these, at least one type of gas selected from the group that includes air, oxygen gas, nitrogen gas, and carbon dioxide gas is preferred.

The means for forming an electric field inside the plasma generation chamber 45 to cause a discharge is not limited in any way, and any known means may be used.

In an embodiment of the present invention, for example, an enclosure 11 (insulator body 41) on whose exterior face or interior face a pair of electrodes 421, 421 having different polarities are formed in a manner separated from and facing each other, wherein the electrodes 421, 421 are each connected to a power supply 7, may be used, as shown in FIG. 4. The pair of electrodes 421, 421 may be provided in a manner facing each other inside the insulator body 41 that forms the plasma generation part 4. Also, one of the pair of electrodes 421, 421, each having a layer such as the insulator body 41 formed on its surface, may be provided. The spacing between the discharge electrodes is not limited in any way and should be optimized as deemed appropriate by considering the voltage, etc., where examples include approx. 0.5 to 5.0 mm. When electrodes are used to cause a discharge, a gaseous flow G2 of high plasma density can be formed.

Additionally, in an embodiment of the present invention, an enclosure 11 (insulator body 41) having a coil 422 provided on its outer periphery or inner periphery and an electrode core (not illustrated in FIG. 5) provided inside the enclosure, where the coil 422 and electrode core are connected to a power supply 7, may be used, as shown in FIG. 5. The winding interval, winding length, winding diameter, and wire diameter of the coil, spacing between the electrode core and the coil, shape of the electrode core, etc., are not limited in any way and optimized as deemed appropriate in consideration of the voltage, etc. For example, causing a discharge using a coil, and a corresponding electrode core, provided on the outer periphery or inner periphery of a cylindrical enclosure 11 spanning from its introduction port 43 to its tip 44, can increase the discharge volume through which the gas passes, despite a relatively low discharge density, and consequently a large quantity of plasma can be generated. This allows the plasma generation chamber 45 (discharge part where the coil is provided) or plasma release port 112 to be separated from the printing medium 3 by a long distance, which is advantageous when designing a printing apparatus.

As a high-frequency, pulse-wave, microwave, or other electric field is applied to the electrodes and coil, a plasma is generated. The generated plasma (atmospheric-pressure plasma) contains all gases resulting from the material gas converted to a plasma and thus being modified.

Under the present invention, preferably pulse waves are applied in order to shorten the time needed for an electric field to rise and fall ("rise" and "fall" refer to continuous increase and decrease in voltage, respectively). The time needed for an electric field to rise and fall is 10 μs or shorter, or preferably 50 ns to 5 μs.

The electric field intensity to be generated at the plasma generation part 4 is not limited in any way. It may be 1 kV/cm or higher, or preferably 20 kV/cm or higher. Also, it may be 1000 kV/cm or lower, or preferably 300 kV/cm or lower. When an electric field is applied using pulse waves, their frequency is not limited in any way. It is preferably 0.5 kHz or higher, and may be approx. 10 to 20 MHz, or approx. 50 to 150 MHz. The electric power may be 40 W/cm or lower, or preferably 30 W/cm or lower.

The electrode 421 or coil 422 may be constituted in a manner not coming in direct contact with the plasma material gas G1, in order to obtain a stable plasma discharge. For this reason, an insulating film may be provided on the surface of the electrode 421 or coil 422 by coating or other known means. Such insulating film may use quartz, alumina, or other glass material, or ceramic material, and the like.

(Plasma Irradiation Part)

The plasma irradiation part 1 brings the gaseous flow G2 ejected from the tip 44, in contact with the surface of the printing medium 3 transferred from the printing part 2. The plasma irradiation part 1 is provided downstream of the printing part 2 in the moving direction of the printing medium 3. Deposited on the surface of the printing medium 3 transferred from the printing part 2 is a recording composition that has just been printed, and when it contacts the gaseous flow G2, this recording composition dries/cures and fixes on the surface of the printing medium 3.

The plasma irradiation part 1 is positioned in such a way that it is connected to the plasma generation chamber 45 at the plasma generation part 4 via the tip 44 (plasma release port 112), while the two are separated from each other spatially at other parts.

In an embodiment of the present invention, the plasma irradiation part 1 is connected to the tip 44 from which the gaseous flow G2 coming out of the plasma release port 112 is released, as well as to the plasma release port 112, and has at least an interior space 15 for bringing the recording composition on the printing medium 3 in contact with the gaseous flow G2, and a wall face 12 separating the interior space 15 from the exterior.

It should be noted that the tip 44 may be constituted substantially by the same part as the plasma release port 112, as shown in FIG. 4 and FIG. 5. Also, the tip 44 may be provided at a position separated from the plasma release port 112 by the enclosure 11. Furthermore, the tip 44 may be formed by connecting a nozzle, hose, or other member to the plasma release port 112.

In an embodiment of the present invention, the plasma irradiation part 1 is constituted in such a way that it has a plasma generation part 4 provided in a manner penetrating the wall face 12 toward the interior space 15 from above, so that the printing medium 3 passes directly below the tip 44 (plasma release port 112), as shown in FIGS. 1 and 2. It should be noted that the plasma generation part 4 may be provided in a manner penetrating the wall face 12 or it may be provided in a manner being stored inside the interior space 15 surrounded by the wall face 12.

The spacing between the tip 44 (plasma release port 112) and the surface of the printing medium 3 is 0.1 mm to 20.0 m, for example.

In an embodiment of the present invention, the printing medium 3 passes through a position close to the tip 44 (plasma release port 112) so as to contact the gaseous flow containing luminous plasma-modified gas P, as shown in FIG. 1. Although the specifics vary depending on the plasma generation conditions, etc., it passes through a position within 10 mm, or preferably within 5 mm, of the plasma release port 112, for example.

In an embodiment of the present invention, the printing medium 3 passes through a position far away from the tip 44 (plasma release port 112) so as to contact the gaseous flow containing plasma-quenched gas as formed by the quenching of a luminous plasma, as shown in FIG. 2. Although the specifics vary depending on the plasma generation conditions, etc., it passes through a position more than 10 mm from the plasma release port 112, for example. Here, a nozzle, hose or other member may be connected to the plasma release port 112. The spacing between the tip of the member provided at the plasma release port 112, and the printing medium 3, may be set to an arbitrary distance, but preferably it is set to within 10 mm to prevent diffusion. When coil discharge is used as the discharge means for generating a plasma, the member provided at the plasma release port 112 can be made long, and accordingly the distance between the plasma generation chamber 45 (discharge part) or plasma release port 112 and the printing medium 3 can be increased.

It should be noted that, while it is not limited in any way, the transfer speed of the printing medium 3 is 0.01 m/s or higher, or preferably 0.01 to 10 m/s.

In an embodiment of the present invention, the shape of the tip 44 (plasma release port 112) may be designed as a tapered nozzle shape, slit shape, long nozzle shape, multi-holed shower head shape, etc. Also, the tip 44 may be formed by attaching to the plasma release port 112 at least one member having a tapered nozzle shape, slit shape, long nozzle shape, shape of a shower head having multiple holes provided at arbitrary intervals, etc.

In an embodiment of the present invention, the plasma irradiation part 1 may be formed using a plasma generation part 4 having multiple plasma release ports 112, in such a way that the multiple plasma release ports 112 are arranged in at least one row along the width direction of the printing medium 3. Also, the plasma irradiation part 1 may be formed using one or more plasma generation parts 4, each having at least one plasma release port 112, arranged in at least one row along the width direction of the printing medium 3. For example, three plasma generation parts 4 are arranged in one row along the width direction of the printing medium 3, as shown in FIG. 7 to FIG. 9.

Placing multiple tips 44 (plasma release ports 112) in the width direction and/or transfer direction of the printing medium 3 allows the gaseous flow G2 to evenly contact the surface of the printing medium 3. Here, the shape of each tip 44 (plasma release port 112) may be a cylinder shape, a slit shape (slim rectangular shape) extending longer in the width direction of the printing medium 3 (roughly as long as the width-direction length of the printing medium 3, for example), a slit shape as described above where the slit is V-shaped, S-shaped, wavy, etc., or a shape of a shower head having multiple holes provided at arbitrary intervals, and the like. In any case, preferably it is constituted so that the gaseous flow G2 can be ejected evenly in the width direction of the printing medium.

In an embodiment of the present invention, the tip 44 (plasma release port 112) of the plasma irradiation part 1 may be formed as a narrow hole, so that the gaseous flow G2 is ejected from the hole with great force.

In an embodiment of the present invention, the tip 44 (plasma release port 112) of the plasma irradiation part 1 (downstream plasma irradiation part 1B) may be shaped like a long nozzle shape (nozzle 46), as shown in FIG. 3. The tip 44 (plasma release port 112) itself may be processed into a nozzle 46, or an extension nozzle (nozzle 46) may be provided on the plasma release port 112. This way, diffusion of the gaseous flow G2 can be prevented, thus achieving a higher density of the plasma and/or quenched plasma coming in contact with the recording composition on the surface of the printing medium 3.

In an embodiment of the present invention, the tip 44 (plasma release port 112) of the plasma irradiation part 1 may be shaped as a shower head having multiple holes formed in it. In this case, the gaseous flow G2 is distributed over a wider range, allowing the gaseous flow G2 to contact the printing medium 3 over a wider area. It should be noted that adopting a shower head shape tends to quicken the quenching of a plasma. Also, adopting a shower head shape requires the gaseous flow G2 in a large quantity, and for these reasons, preferably a plasma is generated through a discharge using a coil.

In an embodiment of the present invention, the tip 44 (plasma release port 112) of the plasma irradiation part 1 may be oriented in an arbitrary direction to adjust the ejection direction of the gaseous flow G2. For example, it may be oriented in one of the following directions, such as: a transfer direction of the printing medium 3; a direction opposite to the transfer direction of the printing medium 3; a direction crossing the transfer direction of the printing medium 3 (width direction of the printing medium 3); a direction toward the surface of the printing medium 3; and a direction not toward the surface of the printing medium 3. In the printing apparatuses shown in FIGS. 1, 2, and 6, for example, the tip 44 (plasma release port 112) of the plasma irradiation part 1 is oriented in a direction that causes the gaseous flow G2 to be released directly toward the printing medium 3. In the printing apparatus shown in FIG. 3, for example, it is oriented in a direction that does not cause the gaseous flow G2 to be ejected directly onto the printing medium 3. If, for example, the tip 44 (plasma release port 112), or tip 44 formed by attaching at least one member to the plasma release port 112, of the plasma irradiation part 1 is shaped as a slit, then the longitudinal direction of the slit may extend in a direction crossing the width direction of the printing medium 3 (the longitudinal direction of the slit corresponds to the width direction of the printing medium 3). Also, the longitudinal direction of the slit may extend in a direction not crossing the width direction of the printing medium 3.

In an embodiment of the present invention, the tip 44 (plasma release port 112) of the plasma irradiation part 1 is not oriented toward the direction of the recording composition on the moving printing medium 3. This way, the gaseous flow G2 is not ejected directly onto the recording composition on the printing medium 3, which in turn prevents the dots and outlines of the recording composition from widening before drying/curing on the printing medium 3. Also, orienting the tip 44 (plasma release port 112) of the plasma irradiation part 1 in the moving direction of the printing medium 3 or a direction moving away from the printing medium 3, creates, in conjunction with the accompanying flows generated by the moving printing medium 3, the effect of allowing the undried/uncured recording composition on the printing medium 3 to remain in contact with the gaseous flow G2 for a longer period. When the gaseous flow G2 is let travel from the tip 44 (plasma release port 112) toward the transfer direction of the printing medium 3, for example, the flow rate of the gaseous flow G2 may be set to approx. 0.8 to 1.2 times, or preferably approx. 0.9 to 1.1 times, the transfer speed of the printing medium 3. This way, the gaseous flow G2 near the undried/uncured recording composition on the printing medium 3 effectively has no flow rate relative to the recording composition, thus allowing the undried/uncured recording composition to dry/cure under no trembling forces and with the printed outlines remaining clear.

In an embodiment of the present invention, the plasma irradiation part 1 may have an inlet opening part 13 and an outlet opening part 14, each of the size needed to let the printing medium 3 go in/out through it, as well as a wall face 12 constituted to let the gaseous flow G2 travel toward the inlet opening part 13 and/or outlet opening part 14, as shown in FIGS. 1 and 2. This way, the gaseous flow G2 comes in direct contact with the recording composition on the printing medium 3, while filling the space 15 through which the printing medium 3 passes. Not only does the recording composition on the printing medium 3 dry/cure due to direct contact with the gaseous flow G2, but this drying/curing is promoted because the recording composition stays in the space filled with the gaseous flow G2 for a long period. Adopting such constitution allows the recording composition to dry/cure fully by supplementing its drying property/curability that often becomes insufficient when a remote plasma is used. Preferably the constitution is such that at least 0.01 seconds, or preferably 0.05 seconds to 30 seconds or so, of contact duration is ensured between the gaseous flow G2 and the recording composition on the printing medium 3.

It should be noted that the "size needed to let the printing medium 3 go in/out through it" may include the size of the printing medium 3, the size of the mechanism for transferring the printing medium 3, and the clearances for preventing paper jamming, etc. Excessive clearances may cause the gaseous flow G2 to dissipate. Accordingly, the size of the inlet opening part 13 and outlet opening part 14 represents the minimum passing cross-section area needed for the printing medium 3 to go in/out through the opening part, while ensuring that the printing medium 3 makes maximum contact with the gaseous flow G2.

In an embodiment of the present invention, the plasma irradiation part 1 may be such that an inlet opening part 13 and an outlet opening part 14 corresponding to an inlet and an outlet for the printing medium 3, respectively, are provided at positions as far away as possible from the tip 44 (plasma release port 112), and also a wall face 12 is provided to form a tunnel that continues from the inlet opening part 13 to the outlet opening part 14 by way of the tip 44 (plasma release port 112). While not limited in any way, the height of the tunnel may be lowered, other than near the tip 44 (plasma release port 112), to the extent that the transfer of the printing medium 3 is not affected. Also, while not limited in any way, the length between the inlet opening part 13 and the outlet opening part 14 (length of the tunnel) may be 5 cm to 10 m or so.

The tip 44 (plasma release port 112) is spatially connected to the inlet opening part 13 and the outlet opening part 14, but separated from the exterior by the wall face 12. This allows the gaseous flow G2 released from the tip 44 (plasma release port 112) to travel toward the inlet opening part 13 and/or outlet opening part 14 in the tunnel. The result is that the printed printing medium 3 remains in contact with the gaseous flow G2 for a long period, which further promotes the drying/curing of the recording composition present on its surface.

In an embodiment of the present invention, a cover 47 enclosing the tip 44 of the plasma irradiation part 1 (tip 44 of the downstream plasma irradiation part 1B) may be provided, as shown in FIG. 3. For the cover 47, a cover of any arbitrary shape, etc., may be used, which may extend in the width direction of the printing medium, or it may be a part similar to the aforementioned wall face 12. With the cover 47, the gaseous flow G2 can be prevented from diffusing, thus achieving a higher density of the plasma and/or quenched plasma in the atmosphere inside the cover 47. Also, providing the cover 47 allows the gaseous flow G2 to be brought in contact with the undried/uncured recording composition on the printing medium 3, without the gaseous flow G2 being released directly toward the recording composition. For example, the tip 44 (plasma release port 112) may be oriented upward to allow the gaseous flow G2 ejected from the tip to remain inside the cover 47, thereby improving the density of the plasma and/or quenched plasma inside the cover 47, while also facilitating its contact with the undried/uncured recording composition on the printing medium 3.

In an embodiment of the present invention, the cover 47 (wall face 12) may surround the tip 44 of the plasma irradiation part 1 (tip 44 of the downstream plasma irradiation part 1B) and the undried/uncured recording composition on the printing medium 3. It should be noted that the shape of the cover (wall face 12) is not limited in any way so long as dissipation of the gaseous flow G2 can be prevented and the drying/curing of the undried/uncured recording composition on the printing medium 3 by the gaseous flow G2 can be promoted.

In an embodiment of the present invention, a backup roll 62 for supporting the printing medium 3 may be provided on the opposite side of the printing medium 3 to the plasma irradiation part 1. The backup roll 62 may be constituted by an arbitrary material, but preferably it is constituted by a conductive material. The backup roll 62 can be connected to the anode side or cathode side of a direct-current power supply to be charged with positive or negative electricity, or it can be connected directly to the ground. If the backup roll 62 is connected to the ground (grounded) or charged with electricity of the polarity opposite to the polarity of plasma particles, a plasma in the plasma-modified gas P and/or a quenched plasma, which are/is released from the plasma release port 112, is electrically directed and attracted to the backup roll 62. As a result, areas of high plasma and/or quenched plasma density generate on the surface side of the printing medium 3 in contact with the backup roll 62, thus allowing the drying/curing process of the recording composition on the printing medium 3 to proceed more efficiently.

Also, in an embodiment of the present invention, a member of any arbitrary shape or structure may be provided in place of the backup roll 62. Such member may be a sheet-shaped or plate-shaped member, or any known suction-holding member or electrostatic chucks for the printing medium 3, and the like. If a member whose surface is a conductor is used, effects similar to those expected from using a backup roll 62 constituted by a conductive material can be achieved.

The foregoing explained embodiments of the printing apparatus and method for manufacturing printed matter proposed by the present invention; however, the present invention is not limited to these embodiments, and may be implemented by adding modifications as deemed appropriate to the extent that the technical ideas of the present invention remain intact.

In an embodiment of the present invention, plasma irradiation parts 1 may be provided in at least two locations, namely, on the downstream side and upstream side of the moving direction of the printing medium 3 with respect to the printing part 2 (printing roller 21), as shown in FIG. 3. In FIG. 3, an upstream plasma irradiation part 1A is provided upstream of the printing roller 21, while a downstream plasma irradiation part 1B is provided downstream of the printing roller 21.

The upstream plasma irradiation part 1A can be of any type, so long as the gaseous flow G2 comes in contact with the unprinted printing medium 3. Preferably it is constituted in such a way that the gaseous flow G2 is released directly onto the unprinted printing medium 3.

This way, the surface of the unprinted printing medium 3 is plasma-treated for improved adhesion with the recording composition.

Also, the plasma and/or quenched plasma will remain for at least several seconds on the surface of the unprinted printing medium 3. Therefore, once the recording composition is printed on the surface of the printing medium 3, the plasma remaining on the surface of the printing medium 3 will accelerate the drying/curing of the recording composition on the inside and/or at the interface with the printing medium 3.

The upstream plasma irradiation part 1A may be constituted using any known plasma treatment device that plasma-treats films and other molded products by spraying an (atmospheric-pressure) plasma thereon. Examples include the RT series and APT series manufactured by Sekisui Chemical Co., Ltd., appropriate plasma treatment devices provided by Yamato Material Co., Ltd., etc., and plasma devices described in Japanese Patent Laid-open No. 2004-207145, Japanese Patent Laid-open No. Hei 11-260597, Japanese Patent Laid-open No. Hei 3-219082, and the like.

Also, the upstream plasma irradiation part 1A may be constituted by, for example, a plasma treatment device having a plasma irradiation part 1, an introduction tube 431 (introduction port 43) for remotely supplying a plasma to the plasma irradiation part 1, and a transfer roll 5, etc., for transferring a resin sheet or other printing medium 3, as shown in FIG. 10.

Also, the upstream plasma irradiation part 1A may be such that, for example, a plasma material gas G1 to be converted to a plasma passes between a pair of electrodes 421 coated with an insulator body 41, and as the plasma material gas G1 passes, it is converted to a plasma by the voltage applied between the electrodes, just like the device shown in FIG. 6. In FIG. 3, a gaseous flow containing plasma-modified gas P passes through the plasma release port 112 and contacts the surface of the printing medium 3. While the plasma release port 112 is oriented downward at an angle in FIG. 3, it can be oriented straight down or in other arbitrary direction.

In an embodiment of the present invention, a backup roll 61 for supporting the printing medium 3 may be provided on the opposite side of the printing medium 3 to the upstream plasma irradiation part 1A, as shown in FIG. 3. The backup roll 61 may be constituted by an arbitrary material, but preferably it is constituted by a conductive material. The backup roll 61 can be connected to the anode side or cathode side of a direct-current power supply to be charged with positive or negative electricity, or it can be connected directly to the ground. If the backup roll 61 is connected to the ground (grounded) or charged with electricity of the polarity opposite to the polarity of plasma particles, a plasma in the plasma-modified gas P and/or a quenched plasma, which are/is released from the plasma release port 112, is electrically directed and attracted to the backup roll 61. As a result, areas of high plasma and/or quenched plasma density generate on the surface side of the printing medium 3 in contact with the backup roll 61, thus allowing for efficient surface treatment, etc., of the printing medium 3.

Also, in an embodiment of the present invention, a member of any arbitrary shape or structure may be provided in place of the backup roll 61. Such member may be a sheet-shaped or plate-shaped member, or any known suction-holding member, or electrostatic chucks for the printing medium 3, and the like. If a member whose surface is a conductor is used, effects similar to those expected from using a backup roll 61 constituted by a conductive material can be achieved.

In an embodiment of the present invention, the tip 44 (plasma release port 112) of the upstream plasma irradiation part 1A may be shaped as a long nozzle (nozzle 46). The tip 44 (plasma release port 112) itself may be processed into a nozzle 46, or an extension nozzle (nozzle 46) may be provided on the plasma release port 112. This way, diffusion of the gaseous flow G2 can be prevented, thus causing the gaseous flow G2 whose plasma and/or quenched plasma density has been adjusted to come in contact with the surface of the printing roller 21. A part of the recording composition on the printing roller 21 that will form the inner side of a recording composition film to be produced by printing, is dried/cured to some extent by the gaseous flow G2 beforehand. The recording composition that has dried/cured to some extent is then transferred onto the printing medium 3, after which it is dried/cured by the gaseous flow G2 so that the entire recording composition, including the inner side, dries/cures with greater certainty.

In an embodiment of the present invention, the tip 44 (plasma release port 112) of the upstream plasma irradiation part 1A may be shaped as a shower head having multiple holes formed on it. In this case, the gaseous flow G2 can be brought in contact with the recording composition on the unprinted printing medium 3 and/or printing roller efficiently over a wider area.

In an embodiment of the present invention, a local ventilation device may be provided near at least one of the inlet opening part 13 and outlet opening part 14 of the plasma irradiation part 1. The gaseous flow G2 may contain ozone and other chemical substances whose release into the work environment is undesirable. Providing a local ventilation device can prevent these chemical substances from being released into the work environment. While providing a local ventilation device only on one side keeps gaseous flow G2 from traveling to the opening part on the side where such device is not provided, it suffices under the present invention that there is a gaseous flow G2 that travels at least in one of the directions toward the inlet opening part 13 and the outlet opening part 14.

In an embodiment of the present invention, a means for recovering the gaseous flow G2 and reusing at least a part thereof as a plasma material gas G1 may be provided. For example, a constitution that provides a circulation circuit to guide the gaseous flow G2 to the introduction port 43 again, or a constitution wherein the gaseous flow G2 is recovered and then stored for subsequent use as a plasma material gas G1, may be provided. Here, a blower or suction device may be provided to adjust the rate of circulation of the gas. Also, a moisture absorption unit or any of various other types of adsorption units may be used to remove moisture content and impurities in the circulating gas.

<Method for Manufacturing Printed Matter>

The method for manufacturing printed matter proposed by the present invention includes: a printing step to perform printing by depositing, on the surface of a printing medium 3, a recording composition having the property to cure upon contacting a gaseous flow (gaseous flow G2) containing plasma-modified gas and/or plasma-quenched gas formed therefrom; and a drying step to bring the gaseous flow G2 in contact with the surface of the printing medium 3 that has completed the printing step, and thereby fix the recording composition present on the surface of the printing medium 3. Preferably the method for manufacturing printed matter proposed by the present invention is implemented using the aforementioned printing apparatus proposed by the present invention. In the following explanations, the explanations of embodiments under <Printing Apparatus> above can be incorporated. Each step is explained below.

[Printing Step]

The printing step is a step to perform printing by depositing, on the surface of a printing medium 3, a recording composition having the property to cure upon contacting a gaseous flow G2.

While the printing medium, recording composition, and printing method are not limited in any way, the printing media 3, recording compositions, and printing methods discussed under <Printing Apparatus> above may be adopted, for example.

After completing the printing step, the printing medium 3 undergoes the drying step.

If the aforementioned printing apparatus proposed by the present invention is used as the printing apparatus, for example, the printing medium 3 that has completed the printing step at the printing part 2 is transferred to the plasma irradiation part 1 by a transfer device (such as transfer roll 5) to undergo the drying step.

[Drying Step]

The drying step is a step to bring the gaseous flow G2 in contact with the surface of the printing medium 3 that has completed the printing step, and thereby fix the recording composition present on the surface of the printing medium 3. Since the recording composition has the property to cure upon contacting the gaseous flow G2, it is dried/cured and thus fixed on the surface of the printing medium 3 in this step. As a result, a tack-free printed matter can be formed.

While the gaseous flow G2 is not limited in any way, it may be the same as the gaseous flow G2 discussed under <Printing Apparatus> above, for example.

While the method and device for generating the gaseous flow G2 are not limited in any way, the methods and devices discussed under <Printing Apparatus> above may be used, for example.

While the method and device for bringing the gaseous flow G2 in contact with the printing medium 3 are not limited in any way, the methods and devices discussed under <Printing Apparatus> above may be used, for example.

EXAMPLES

The present invention is explained in greater detail below by citing examples;

however, the present invention is not at all limited to these examples. It should be noted that, in the following descriptions, unless otherwise specified, "percent" and "part" refer to "percent by mass" and "part by mass," respectively.

[Preparation of Varnish]

Into a four-way flask equipped with a cooling tube, a thermometer, and an agitator, 40.5 parts of a rosin-modified phenolic resin with a weight-average molecular weight of 50000 to 60000 (Hariphenol P-160, manufactured by Harima Chemicals, Inc.) and 58.9 parts of soybean oil were loaded and then the flask was heated to 210° C. and maintained at this temperature for 40 minutes to dissolve the resin, after which 0.6 parts of an aluminum ethyl acetoacetate diisopropylate (ALCH, manufactured by Kawaken Fine Chemicals Co, Ltd.) was loaded and the mixture was then held under heating at 170° C. for 50 minutes, to obtain a varnish.

[Preparation of Ink Compositions]

The various materials were mixed according to the recipes shown in Table 1, and then kneaded using a three-roll mill, to prepare the ink compositions of Inks 1 to 5. The compounding quantity of each component shown in Table 1 is in parts by mass. In Table 1, the "color pigment" is phthalocyanine which is a coloring pigment.

TABLE 1

| | Ink 1 | Ink 2 | Ink 3 | Ink 4 | Ink 5 |
|---|---|---|---|---|---|
| Varnish | 58 | 58 | 58 | 58 | 58 |
| Color pigment | 17 | 17 | 17 | 17 | 17 |
| Soybean oil | 20 | 15 | 10 | 5 | — |
| Castor oil | 5 | 10 | 15 | 20 | 25 |
| Total | 100 | 100 | 100 | 100 | 100 |

[Curing Test]

The ink compositions of Inks 1 to 5 were evaluated for curability by plasma irradiation using the plasma irradiation part 1 described in FIG. 1. First, a 0.1-cc sample was taken from each of the ink compositions and transferred onto a PP (polypropylene) film (manufactured by Sekisui Seikei Co., Ltd., product name: Polysame PC-8162) using an RI color transfer machine (two-piece roll, manufactured by Akira Seisakusho Co, Ltd.), after which the color-transferred film was passed through the plasma irradiation part 1 from its inlet opening part 13 toward outlet opening part 14 at a transfer speed of 0.5 m/sec. This was done by using air as a plasma material gas (flow rate 5 l/min) and setting the diameter of the plasma release port to 1 mm, and the spacing between the plasma release port 112 and the color-transferred film to 4 mm. When the surfaces of the respective color-transferred films were wiped with an absorbent cotton pad, none of the ink compositions attached to the absorbent cotton pad, confirming that all ink compositions had cured (fixed).

What is claimed is:

1. A printing apparatus, comprising:

a printing part that performs printing by depositing a recording composition on a surface of a printing medium;

an upstream plasma irradiation part provided upstream of the printing part with respect to a moving direction of the printing medium, wherein, before printing of the printing medium, the upstream plasma irradiation part releases directly onto the moving printing medium a gaseous flow containing plasma-modified gas and/or plasma-quenched gas formed therefrom;

a plasma generation part provided downstream of the printing part with respect to the moving direction of the printing medium, wherein the plasma generation part is constituted by a plasma generation chamber comprising: an introduction port for introducing a gaseous flow of plasma material gas to an interior, wherein the plasma material gas is converted to a plasma in the interior to form a gaseous flow of plasma-modified gas; and a plasma release port for releasing the gaseous flow to an exterior; and a downstream plasma irradiation part that brings a gaseous flow released from the plasma release port, which contains the plasma-modified gas and/or plasma-quenched gas formed therefrom, in contact with the surface of the printing medium that has been printed at the printing part, wherein an opening part of the downstream plasma irradiation part, which communicates with the plasma release port and through which the gaseous flow from the plasma release port is released, is not oriented in a surface direction of the printing medium, and wherein, at the downstream plasma irradiation part, a member, which is connected to a ground or charged with electricity opposite to plasma particles contained in the gaseous flow from the plasma release port, is placed on an opposite side of the printing medium as viewed from the plasma release port in a manner electrically directing and attracting the plasma particles toward the member.

2. The printing apparatus according to claim 1, wherein the gaseous flow containing plasma-modified gas is brought in contact with the surface of the printing medium that has been printed at the printing part.

3. The printing apparatus according to claim 1, wherein the gaseous flow containing plasma-quenched gas is brought in contact with the surface of the printing medium that has been printed at the printing part.

4. The printing apparatus according to claim 1, wherein:

the printing part is a printing part that performs printing using a printing roller;

the plasma generation part generates an atmospheric-pressure plasma; and the downstream plasma irradiation part has a tip from which the gaseous flow is released and which is oriented in such a direction that the gaseous flow will not be released directly onto the printing medium.

5. The printing apparatus according to claim 1, wherein:

the printing part is a printing part that performs printing using a printing roller;

the plasma generation part generates an atmospheric-pressure plasma; and the downstream plasma irradiation part has a tip from which the gaseous flow is released, as well as a cover enclosing the tip and extending in a width direction of the printing medium, and the gaseous flow is released into the cover from the tip.

6. The printing apparatus according to claim 1, wherein the plasma generation part and the downstream plasma irradiation part are placed in such a way that they are connected to each other via the plasma release port, while separated from each other spatially other than at this connected location.

7. The printing apparatus according to claim 1, wherein the downstream plasma irradiation part has a wall face provided with an inlet opening part and an outlet opening part, each of a size needed to let the printing medium go in/out through it.

8. The printing apparatus according to claim 1, wherein the opening part of the downstream plasma irradiation part is oriented in a moving direction of the printing medium so that the gaseous flow of plasma-modified gas and/or plasma-quenched gas is oriented in a direction in which the printing medium moves.

9. A method for manufacturing printed matter, comprising:

a plasma irradiation step to release directly onto a moving printing medium a gaseous flow containing plasma-modified gas and/or plasma-quenched gas formed therefrom before printing of the printing medium;

a printing step to perform printing by depositing, on a surface of a printing medium, a recording composition having a property to cure upon contacting a plasma-modified gas and/or plasma-quenched gas formed therefrom; and a drying step to bring a gaseous flow of plasma-modified gas and/or plasma-quenched gas in contact with the surface of the printing medium and thereby fix the recording composition present on the surface of the printing medium;

wherein, in the drying step, in a plasma generation chamber which is connected via a plasma release port to a space through which the printing medium passes and which is separated from the space, a plasma material gas is introduced into the plasma generation chamber from an introduction port different from the plasma release port to form a gaseous flow traveling from the introduction port to the plasma release port, so that the gaseous flow is converted to a plasma in the plasma generation chamber and a plasma-modified gas is generated, after which the plasma-modified gas is released from the plasma release port into the space through which the printing medium passes in order to bring a gaseous flow containing the plasma-modified gas and/or a plasma-quenched gas formed therefrom in contact with the surface of the printing medium that has been printed in the printing step, wherein, in the drying step, the gaseous flow is released from the plasma release port through an opening part of the plasma release port, wherein the opening part is not oriented in a surface direction of the printing medium, and wherein, in the space through which the printing medium passes in the drying step, a member, which is connected to a ground or charged with electricity opposite to plasma particles contained in the gaseous flow from the plasma release port, is placed on an opposite side of the printing medium as viewed from the plasma release port in a manner electrically directing and attracting the plasma particles toward the member.

10. The method for manufacturing printed matter according to claim 9, wherein the space through which the printing medium passes is covered with a wall face having an inlet opening part and an outlet opening part, each of a size needed to let the printing medium go in/out through it, and the gaseous flow containing plasma-modified gas and/or plasma-quenched gas will flow at least in one of directions toward the inlet opening part and the outlet opening part.

11. The printing apparatus according to claim 2, wherein the plasma generation part and the downstream plasma irradiation part are placed in such a way that they are connected to each other via the plasma release port, while separated from each other spatially other than at this connected location.

12. The printing apparatus according to claim 2, wherein the downstream plasma irradiation part has a wall face provided with an inlet opening part and an outlet opening part, each of a size needed to let the printing medium go in/out through it.

13. The printing apparatus according to claim 2, wherein the opening part of the downstream plasma irradiation part is oriented in a moving direction of the printing medium so that the gaseous flow of plasma-modified gas and/or plasma-quenched gas is oriented in a direction in which the printing medium moves.

14. The printing apparatus according to claim 3, wherein the plasma generation part and the downstream plasma irradiation part are placed in such a way that they are connected to each other via the plasma release port, while separated from each other spatially other than at this connected location.

* * * * *